US005620265A

United States Patent [19]

Kondo

[11] Patent Number: 5,620,265

[45] Date of Patent: Apr. 15, 1997

[54] INK RIBBON CARTRIDGE

[75] Inventor: Shinichi Kondo, Miyagi, Japan

[73] Assignee: Sony Corporation, Japan

[21] Appl. No.: 357,920

[22] Filed: Dec. 16, 1994

[30] Foreign Application Priority Data

Dec. 28, 1993 [JP] Japan ..... 5-335370

[51] Int. Cl.[6] ..... B41J 32/00

[52] U.S. Cl. ..... 400/196; 242/343.2; 242/345.2

[58] Field of Search ..... 400/207, 208, 400/208.1, 234, 242, 246, 196; 242/343.2, 345.2, 347, 423.1, 423.2

[56] References Cited

U.S. PATENT DOCUMENTS

| | | | |
|---|---|---|---|
| 4,797,690 | 1/1989 | Takita et al. | 400/234 |
| 4,892,425 | 1/1990 | Shimizu et al. . | |
| 4,978,240 | 12/1990 | Katsuno | 400/224.2 |
| 5,110,228 | 5/1992 | Yokomizo . | |
| 5,253,941 | 10/1993 | Kamoda | 400/692 |
| 5,290,114 | 3/1994 | Asami et al. . | |
| 5,352,049 | 10/1994 | Shiraishi et al. | 400/208 |
| 5,399,034 | 3/1995 | Fujii et al. | 400/207 |
| 5,415,486 | 4/1995 | Wouters et al. | 400/692 |
| 5,447,382 | 9/1995 | Yui et al. | 400/207 |
| 5,492,422 | 2/1996 | Kondo | 400/208.1 |
| 5,513,920 | 5/1996 | Whritenor et al. | 400/242 |

FOREIGN PATENT DOCUMENTS 0358520 3/1990 European Pat. Off. .

*Primary Examiner*—Edgar S. Burr
*Assistant Examiner*—Daniel J. Colilla
*Attorney, Agent, or Firm*—Ronald P. Kananen

[57] ABSTRACT

An ink ribbon cartridge includes a detachable ink ribbon spool which may be rotatably mounted in a lower shell of the cartridge via first and second shank portions axially projected from opposite sides of the spool. The first shank is of a rod shaped configuration, and includes at least large and small circumference sections which are longitudinally spaced apart. According to such configuration, the spool may be installed only in a compatible ink ribbon cartridge having a lower shell including a first bearing member formed with a first bearing groove rotatably supporting the large circumference section of the first shank and having a width proportional thereto. A second bearing member is disposed adjacent to, and spaced apart from, the first bearing member. The second bearing member includes a second bearing groove having a width proportional to the small circumference section of the first shank. A third bearing member is formed at a location in said lower shell opposing the first bearing member such that the second shank of the spool is rotatably supported thereby. According to this, various configurations of spools and compatible lower shells may be realized which may be utilized for distinguishing between various types of ink ribbon, etc. Since a spool may only be mounted in a lower shell of compatible configuration, misassembly during manufacturing is prevented. In addition, user error, such as accidental installation of an inappropriate ink ribbon, may be surely prevented.

10 Claims, 5 Drawing Sheets

(PRIOR ART)

INK RIBBON CARTRIDGE

BACKGROUND OF THE INVENTION

1. Field of The Invention

The present invention relates generally to a ribbon cartridge for a printer apparatus. Particularly, the invention relates to an ink ribbon cartridge for a heat sublimation or vapor type printer in which compatibility between the cartridge and an ink ribbon spool replacably mounted therein may be definitely established at the time of installation.

2. Description of The Related Art

Various types of ink ribbon cartridges are available for printing apparatus. Heat vaporization or heat sublimation printers generally use an ink ribbon having a sublimation dye thereon. The ribbon is arranged over a sheet of paper, or the like, on which an image is to be printed. Then a thermal head is energized in conformance with the image contours and heats the dye contained in the ink ribbon which is sublimated and transferred to the paper according to the thermal energy generated at the thermal head of the printer.

Some varieties of printers utilize an ink ribbon cartridge for full color printing in which a printing operation must be repeated several times, for example, three times for printing each primary color, magenta, cyan and yellow, resulting in a full-color image. In some such printers, a single ink ribbon cartridge is utilized in which an ink ribbon spool mounted therein is interchanged for printing each of the different colors.

One example of such a conventional. interchangable-spool type ink ribbon cartridge is disclosed in U.S. Pat. No. 5,290,114. The structure of such a cartridge is shown in FIGS. 6 and 7. As may be seen, the ink ribbon cartridge comprises an ink ribbon 1 having a predetermined length and wound around a main spool 2. A free end of the ink ribbon 1 is connected to a take-up spool 3 for being wound onto the take-up spool 3 according to printer operation. The cartridge body is formed such that the spools 2, 3 are rotatably supported and accommodated in a lower shell 4, and an upper shell 5 is mounted thereon. The main spool 2 and the take-up spool 3 have substantially identical bearing portions which will be described hereinbelow.

Each of the spools 2, 3 has a cylindrical shank 2*a*, 3*a* at a first end thereof which is slightly larger in diameter than the winding surface of the spools 2, 3. The other ends of each of the spools 2, 3 are provided with a smaller diameter rod-shaped shank 2*b*, 3*b*. Flange portions 2*c*, 2*d*, 3*c*, 3*d* divide the shank ends 2*a*, 2*b*, 3*a*, 3*b* from the main winding surface of the spools 2, 3 so as to define a winding area for the ink ribbon 1 between pairs of flanges 2*c*, 2*d* and 3*c*, 3*d* respectively.

The lower shell 4 includes a window 6 in a central portion thereof for allowing access of the thermal head (not shown). Annular bearing portions 7, 7 are integrally formed with a side wall 4*a* of the lower shell, openings defined in the annular bearing portions 7, 7 are sized to receive the cylindrical shanks 2*a*, 3*a* of the spools 2, 3. At the other side of the lower shell 4, second bearing portions 8, 8 are formed for receiving the rod-shaped shanks 2*b*, 3*b* of the spools 2, 3. The second bearing portions 8, 8 are formed as wall segments within the lower shell, each of the wall segments having U-shaped grooves 8*a*, 8*a* respectively formed therein for receiving the shanks 2*b*, 3*b*. A reinforcing rib 9 is provided between each of the second bearing portions 8, 8 and a side wall 4*b* of the lower shell 4, which is opposite the side wall 4*a*.

An upper shell 5 includes a side wall that engages with and is mounted to the side wall 4*b* and includes a cover portion 11 disposed over the rod-shaped shanks 2*b*, 3*b* and having internal structure to cooperate with the second bearing portions 8, 8 to rotatably mount the spools 2, 3 at each end thereof. The structure of the cover portion 11 cooperates with the bearing portions 8, 8 of the lower shell 4, and includes springs 10, 10.

For loading the spools 2, 3 into the lower shell 4, the cylindrical shanks 2*a*, 3*a* of the main and take-up spools 2, 3 are inserted into the annular bearing portions 7, 7 and the rod-shaped shanks 2*b*, 3*b* may simply be dropped into the U-shaped grooves of the second bearing portions 8, 8 for rotatably mounting the spools 2, 3 in the lower shell 4. The upper shell 5 may then be snapped on over the second bearing portions and the ribbon cartridge complete with the second, rod-shaped shanks being secured in a rotatably pressed state.

According to this, referring to FIG. 7, a width B of the U-shaped groove 8*a* of the second bearing portion 8 of the take-up spool 3 particularly, is made to be slightly larger than a width A of the rod-shaped shank 3*b* of the spool 3 for assuring easy rotation thereof in a mounted condition.

Accordingly, an appropriate-ink ribbon cartridge may be selected according to a color to be printed, ribbon/printer compatibility, type of printing to be performed, a winding orientation of the ink ribbon, or of a printing surface thereof, etc. However, according to the above described ink ribbon cartridge structure, in a detachable spool type cartridge wherein the same cartridge body is re-used while ink ribbon spools are changed according to the above-listed criteria, the above cartridge structure does not allow a user to verify compatibility of the spool with the cartridge or the printer or printing job to be accomplished. According to this, a user may easily install an inappropriate spool into the lower shell 4 of the cartridge. Such error may cause a printing operation to be flawed, or at worst, may cause jamming or malfunction of the printer due to incompatibility between the ink ribbon and the type of printer.

Thus, it has been required to provide a detachable spool type ink ribbon cartridge in which compatibility of the spool (and thus the ink ribbon) may be reliably established at the time of installation of the spool into the cartridge body.

SUMMARY OF THE INVENTION

It is therefore a principal object of the present invention to overcome the drawbacks of the related art.

It is a further object of the present invention to provide a detachable spool type ink ribbon cartridge with simple structure, in which compatibility of the spool may be reliably established at the time of installation of the spool into the cartridge body.

In order to accomplish the aforementioned and other objects, an ink ribbon cartridge is provided, comprising: a pair of spools having an ink ribbon wound therebetween around central, axially extending cylindrical winding surfaces thereof and respectively including first and second shank portions axially projected from opposing end portions of the cylindrical winding surfaces; a shell including a plurality of bearing portions rotatably supporting the pair of spools at the shank portions; and compatibility determining means disposed along and cooperative with at least one of the shank portions.

According to another aspect of the invention, an ink ribbon cartridge is provided wherein an ink ribbon is wound on a rotatable spool which is detachably installable in the cartridge, the cartridge comprising: a cartridge shell including a first and second bearing portions arranged so as to oppose one another; a main spool having a cylindrical winding surface at a substantially central longitudinal portion thereof and first and second shank portions projected axially from opposite ends of the main spool for rotatably mounting the main spool according to engagement with the first and second bearing portions; and a third bearing portion disposed between the first and second bearing portions and receivable of one of the first and second shank portions, only at a reduced diameter portion thereof.

According to still another aspect of the invention, an ink ribbon cartridge utilizing a detachable ink ribbon spool is provided, comprising: an ink ribbon spool having an ink ribbon wound around a cylindrical winding surface thereof, the spool further including first and second shank portions axially projected from opposite sides thereof; the first shank having a rod shaped configuration including at least first and second sections being axially spaced apart along the first shank, the first and second sections having mutually different circumferential dimensions; a first bearing member formed with a first bearing groove, a width of the first bearing groove selected for rotatably supporting only one of the first and second sections having a larger circumference; a second bearing member disposed adjacent to, and spaced apart from, the first bearing member and including a second bearing groove, a width of the second bearing groove selected for rotatably supporting only one of the first and second sections having a smaller circumference; and a third bearing member, formed at a location in the lower shell opposing the first bearing member such that the second shank of the spool is rotatably supported thereby.

DESCRIPTION OF THE PREFERRED EMBODIMENT

Figure 1:
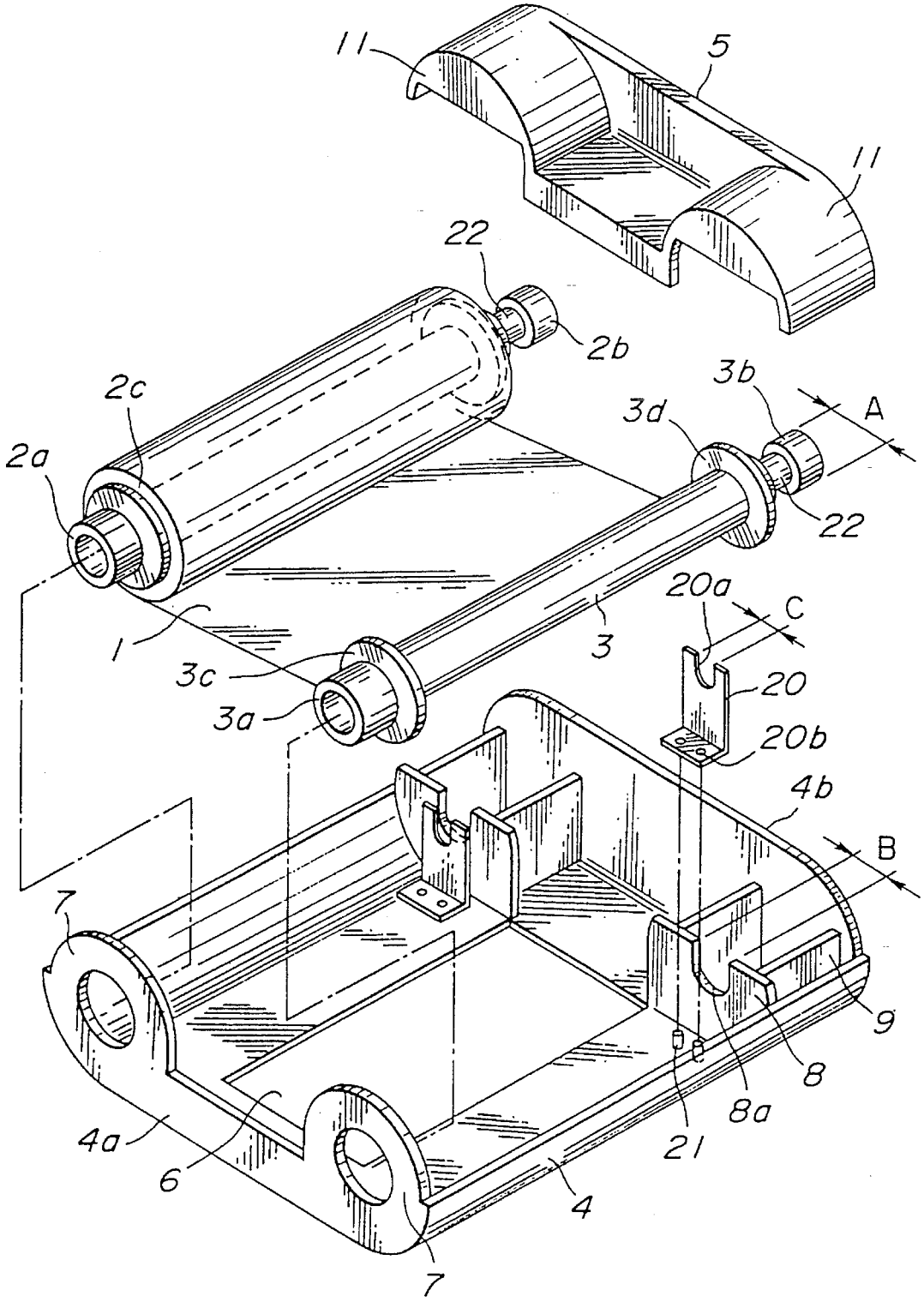
FIG. 1 is an exploded perspective view of an ink ribbon cartridge according to a preferred embodiment of the invention.

Referring now to the drawings, particularly. to FIGS. 1–5, an ink ribbon cartridge according to the invention will be described hereinbelow in detail. According to the following description of the invention, like parts will be described with the same reference numbers as the above-described prior art for ease of understanding.

Similarly to the above-described conventional ink ribbon cartridge, as may be seen in FIG. 1, an ink ribbon cartridge according to the invention comprises an ink ribbon 1 of a preselected length provided wound on a main spool 2 and rotatably disposed such that the ink ribbon 1 may be wound between the main spool 2 and a take-up spool 3. An upper shell 5 may be installed over one end of the spools 2, 3.

The lower shell 4 includes a window 6 in a central portion thereof for allowing access of the thermal head (not shown). Annular bearing portions 7, 7 are integrally formed with a side wall 4*a* of the lower shell, openings defined in the annular bearing portions 7, 7 are sized to receive the cylindrical shanks 2*a*, 3*a* of the spools 2, 3. At the other side of the lower shell 4, second bearing portions 8, 8 are formed for receiving the rod-shaped shanks 2*b*, 3*b* of the spools 2, 3. The second bearing portions 8, 8 are formed as wall segments within the lower shell, each of the wall segments having U-shaped grooves 8*a*, 8*a* respectively formed therein for receiving the shanks 2*b*, 3*b*. Also, as in the above-described conventional structure, one or more reinforcing ribs 9 may be provided between each of the second bearing portions 8, 8 and a side wall 4*b* of the lower shell 4, which is on a side of the lower shell opposite the side wall 4*a* and disposed parallel thereto.

Figure 3:
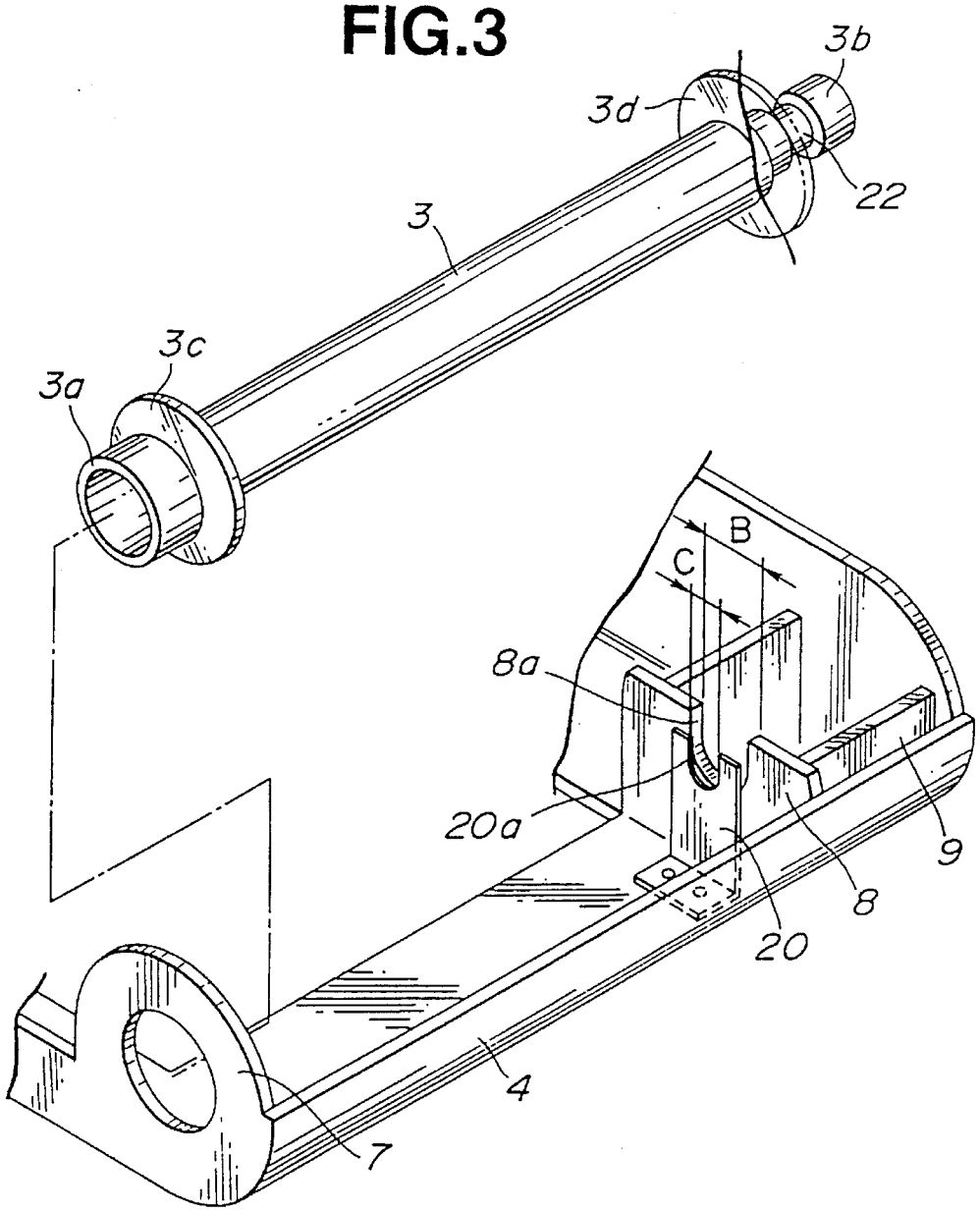
FIG. 3 is an enlarged exploded perspective view of a principle feature of the ink ribbon cartridge of FIG. 1.

Referring to FIGS. 1 and 3, it may be seen that the lower shell 4 of the invention further includes third bearing portions 20, 20 which further serve as compatibility detecting means for assuring compatibility between the spools 2, 3 and the ink ribbon cartridge, as will be explained hereinbelow.

Each of the third bearing portions 20, 20 is formed of substantially L-shaped plate spring material, U-shaped bearing groove 20*a* is formed in a top edge thereof. The flat vertical portion of the third bearing portion 20 is arranged parallel to the second bearing portion 8, separated therefrom by a predetermined gap. The horizontal section of the L-shaped third bearing portion 20 includes mounting holes 20*b*, 20*b* and is affixed to a bottom surface of the lower shell 4 by a pair of caulking pins 21, 21 which serve to determine the correct positioning of the third bearing portion 20. The precise positioning of the third bearing portion 20 and the width C of the bearing groove 20*a* may be established for allowing compatibility of an spool 2, 8 installed in the lower shell to be reliably determined as will be further described hereinlater.

Figure 2:
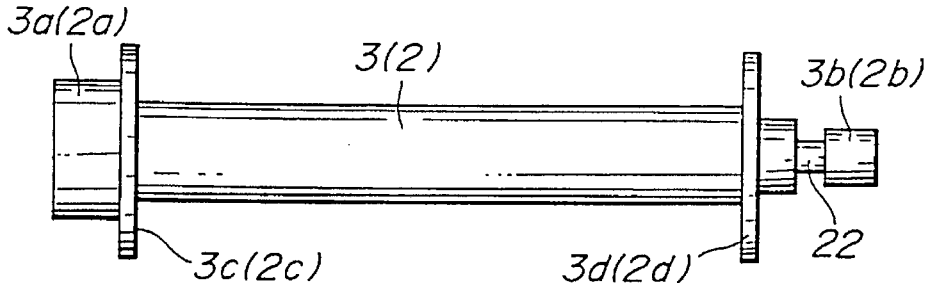
FIG. 2 is a plan view of a spool configuration according to the invention.

Referring now to FIGS. 1–3 a structure of the spools 2, 3 of the ink ribbon cartridge according to the invention will be set forth in detail. As may be appreciated, each of the spools 2, 3 has a cylindrical shank 2*a*, 3*a* at a first end thereof which is slightly larger in diameter than the winding surface of the spools 2, 3, similar to the conventional arrangement. However, according to the invention, the other ends of each of the spools 2, 3 are provided with a two-stage small diameter rod-shaped shank 2*b*, 3*b* having a main section of the shank 2*b*, (3*b*) which is slightly smaller in diameter than the cylindrical winding surface of the spool, as is conventional, and a smaller diameter section 22 formed in a central portion of the shank 2*b* (3*b*). Thus, as best seen in FIG. 2, a shank with essentially two different diameter portions 22 and 2*b* is provided. The width C of the bearing groove 20*a* of third bearing portion 20 is thus made to be smaller than of the bearing groove 8*a* of the second bearing portion 8 and positioned so as to correspond to the position of the smaller diameter portion 22. Thus, it may be assured that a spool which is not in conformity in these respects with a given lower shell 4, may not be inserted thereinto.

As with the previously described related art, flange portions 2*c*, 2*d*, 3*c*, 3*d* divide the shank ends 2*a*, 2*b*, 3*a*, 3*b* from the main winding surface of the spools 2, 3 so as to define a central winding area for the ink ribbon 1 between pairs of flanges 2*c*, 2*d* and 3*c*, 3*d* respectively.

Figure 4:
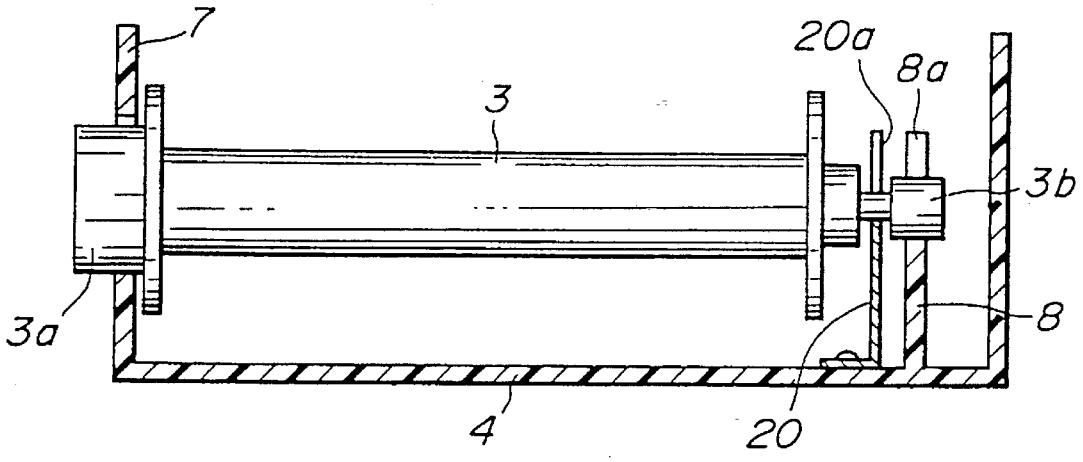
FIG. 4 is a cross-sectional view of a spool installed in an ink ribbon cartridge of the invention.

For loading the spools 2, 3 into the lower shell 4, the cylindrical shanks 2*a*, 3*a* of the main and take-up spools 2, 3 are inserted into the annular bearing portions 7, 7 and the rod-shaped shanks 2*b*, 3*b*. The larger diameter section of the rod-shaped second shanks 2*b*, 3*b* of the spools 2, 3 may easily drop into the U-shaped grooves of the second bearing portions 8, 8 to allow the spools to be simply loaded into the lower shell 4, if the placement of the smaller diameter portion 22 of the rod-shaped shank 2*b* (3*b*) is longitudinally positioned on the shank 2*b* so as to coincide with the position of the third bearing member 20, as seen in FIG. 4. As noted in the conventional structure, a width B of the U-shaped groove 8*a* of the second bearing portion 8 of the spool 2 (3) is made to be slightly larger than a width A of the rod-shaped shank 2*b* (3*b*) of the spool 2 (3) for assuring easy rotation of thereof in a mounted condition.

It will also be noted that the width of the third bearing portion 20 may be provided greater than the width of the smaller diameter portion 22 for allowing easy installation and rotation of the spool while still establishing a positional relationship for engagement of the smaller diameter portion. 22 with the third bearing portion 20 which assures that only a compatible spool 2 (3) will be insertable into the lower shell 4. That is, if for example, it was attempted to install a conventional spool not having the smaller diameter portion 22 formed thereon into the lower shell 4 according to the invention, the narrow width of the bearing groove 20*a* would prevent insertion of the spool. Thus, the present embodiment provides a simple, low cost and highly reliable method of determining compatibility between spool and cartridge.

This feature has many advantageous applications, particularly, for example, in a manufacturing context wherein different types of ink ribbon cartridges for various different applications are assembled at one factory, placement of the smaller diameter portions 22 of various types of spools and positioning of the third bearing portion 20 of their compatible shells may be established such that misassembly becomes impossible, since only the correct, compatible type of spool may be inserted in a particular shell.

An upper shell 5 of the ink ribbon cartridge, which may be utilized in the present embodiment, includes a side wall that engages with and is mounted to the side wall 4*b* and includes semicircular bearing cover portions 11 disposed over each of the rod-shaped shanks 2*b*, 3*b*. The upper shell 5 is configured so as to cooperate with the second bearing portions 8, 8 to rotatably mount the spools 2, 3 at each end thereof. The upper shell 5 may be snapped on over the second bearing portions 8, 8 of the ink ribbon cartridge.

Figure 5:
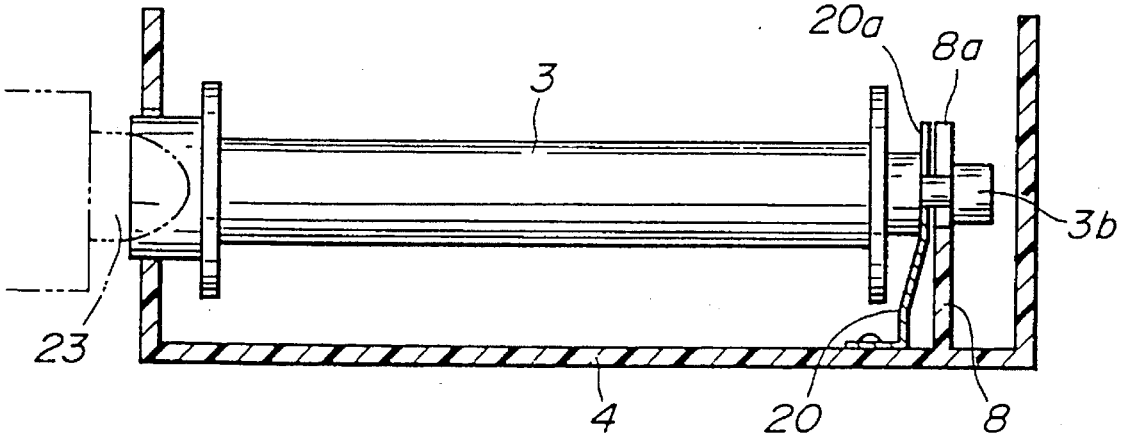
FIG. 5 is a cross-sectional view for explaining installation of the ink ribbon cartridge of the invention into a printer.
Figure 6:
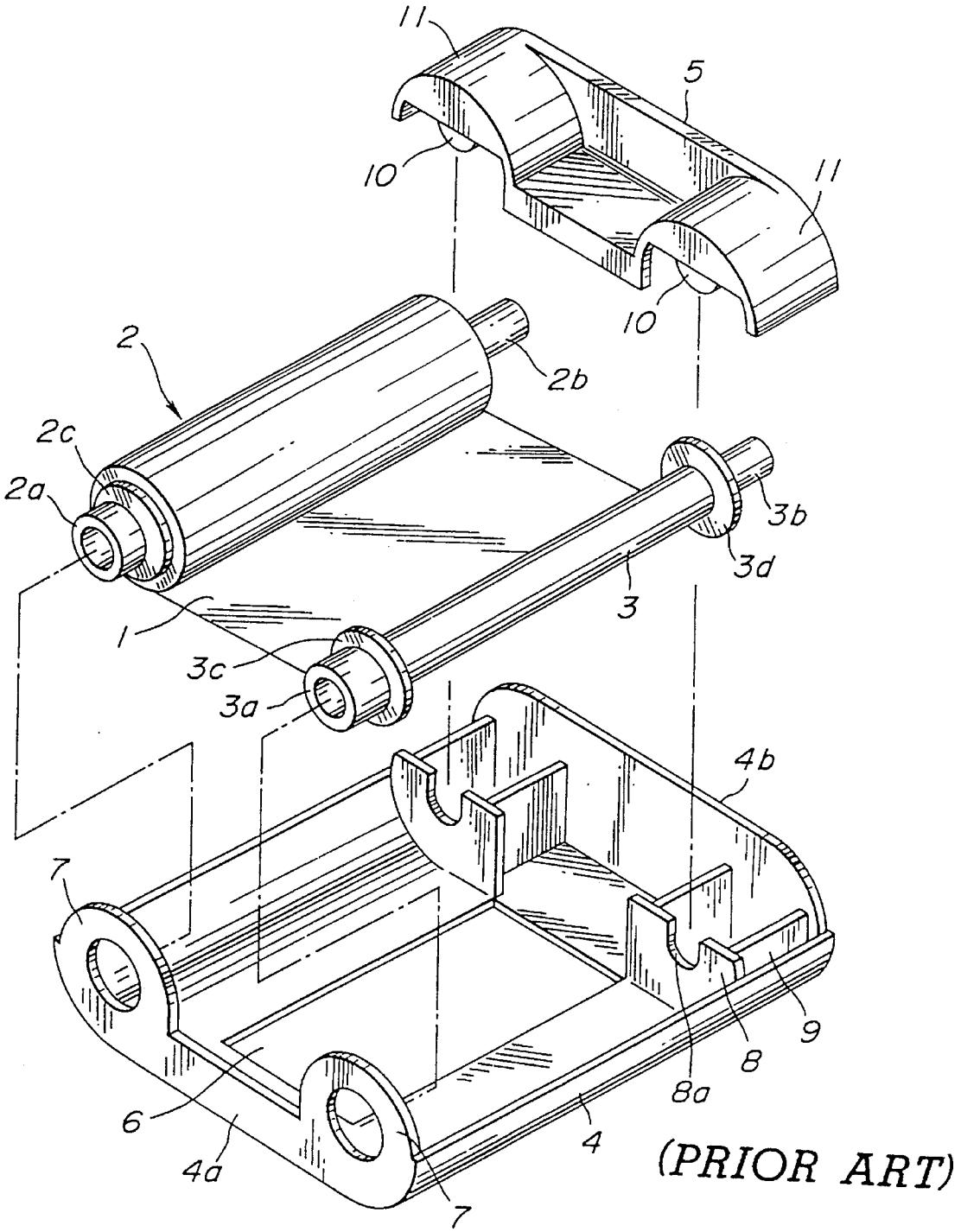
FIG. 6 is an exploded perspective view of a conventional ink ribbon cartridge.
Figure 7:
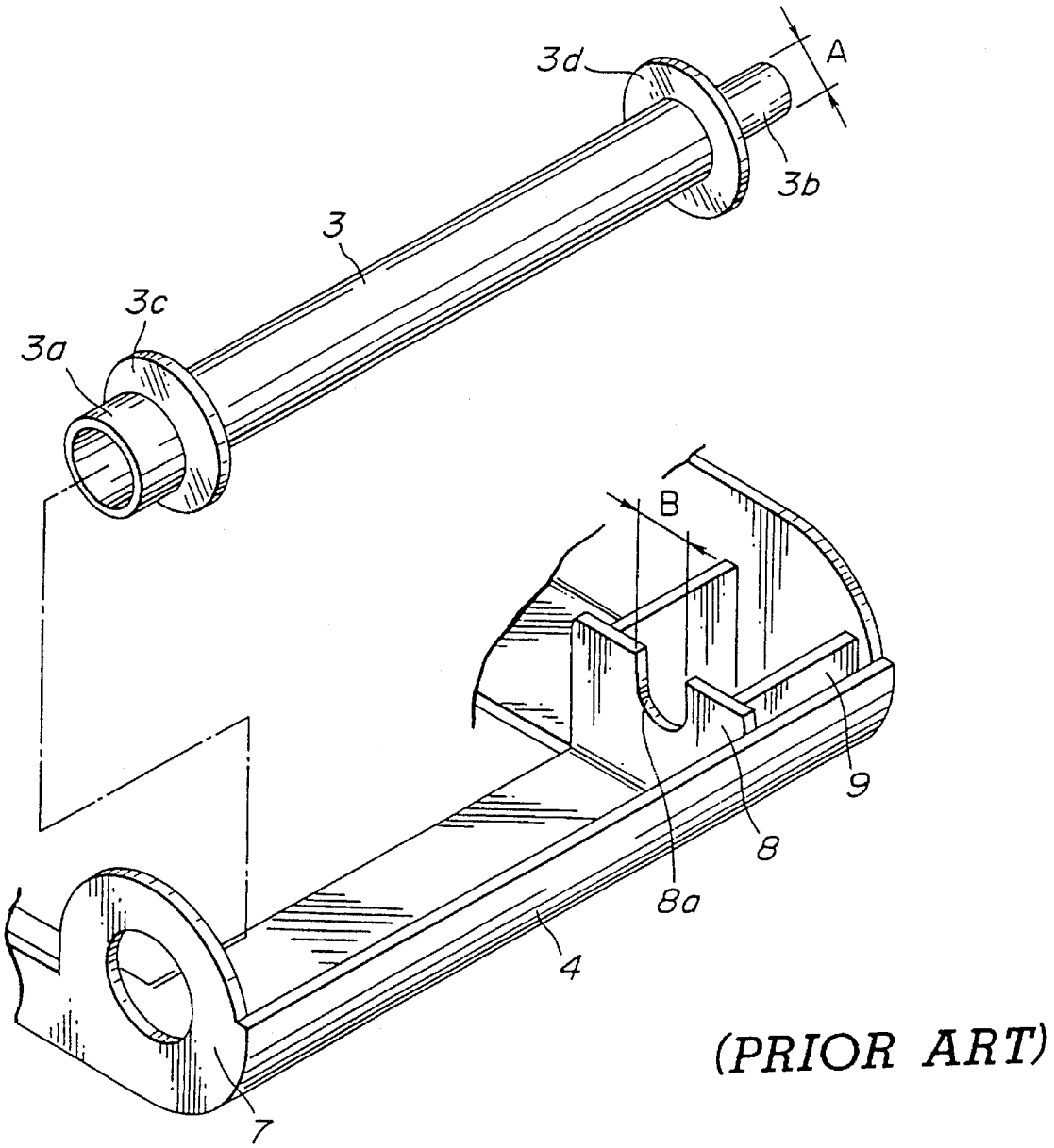
FIG. 7 is an enlarged exploded perspective view of a main portion of the conventional ink ribbon cartridge of FIG. 6.

Hereinbelow, operation of the ink ribbon cartridge according to the invention when installed in a printer for effecting printing operation will be described in detail with reference to FIG. 5.

When the cartridge such as described above is inserted into a printing apparatus (not shown) to effect printing operation, a drive member 23 of the printer is engaged with the first shank 2*a* (3*a*) of the spool 2 (3) for drivingly controlling rotation thereof. As may be seen in the drawing, when the drive member 23 is inserted into the first cylindrical shank 2*a*, the spool 2 is pushed in the direction of the two-stage small diameter second rod-shaped shank 2*b* such that the third bearing member 20 is urged to bend slightly. According to this, sure rotational driving of the spool 2 may be assured.

Thus an ink ribbon cartridge fulfilling the stated objects of the invention is obtained yielding various advantageous effects via simple structure.

Although the above-described preferred embodiment applies to a printer cartridge mounting a pair of spools 2, 3, the structure of the present invention may be applied to other types of ribbon cartridge structures including, for example, cartridges mounting a single spool only, typewriter ribbon cartridges, commercial printing machines, etc.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An ink ribbon cartridge comprising;

a pair of spools having an ink ribbon wound therebetween around central, axially extending cylindrical winding surfaces thereof and respectively including first and second shank portions axially projected from opposing end portions of said cylindrical winding surfaces;

a shell including a plurality of bearing portions rotatably supporting said pair of spools at said shank portions, said plurality of bearing portions including respective first and second bearing portions; and compatibility determining means disposed along and cooperative with at least one of said shank portions, said compatibility determining means being disposed between said first and second bearing portions;

wherein said compatibility determining means comprises a circumferential groove formed on a selected one of said shank portions and a member defining a recess, a position of said member and a width of said recess being determined such that said recess may receive and rotatably support said shank only at the circumferential groove thereof.

2. An ink ribbon cartridge as set forth in claim 1, wherein said compatibility determining means include respective third bearing portions rotatably supporting said pair of spools at said shank portions.

3. An ink ribbon cartridge, comprising:

a pair of spools having an ink ribbon wound therebetween around central, axially extending cylindrical winding surfaces thereof and respectively including first and second shank portions axially projected from opposing end portions of said cylindrical winding surfaces;

a shell including a plurality of bearing portions rotatably supporting said pair of spools at said shank portions; and compatibility determining means disposed along and cooperative with at least one of said shank portions;

wherein said compatibility determining means comprises a circumferential groove formed on a selected one of said shank portions and a member defining a recess, a position of said member and a width of said recess being determined such that said recess may receive and rotatably support said shank only at the circumferential groove thereof;

wherein said plurality of bearing portions includes respective first, second and third bearing portions; and wherein said third bearing portion is disposed between said first and second bearing portions.

4. An ink ribbon cartridge as set forth in claim 3, wherein an installation position of said third bearing portion and a size of said circumferential groove is variable.

5. An ink ribbon cartridge as set forth in claim 4, wherein said third bearing portion is formed of a spring material disposed so as to apply biasing force in a longitudinal direction of an associated one of said spools.

6. An ink ribbon cartridge as set forth in claim 3, wherein said third bearing portion is formed of a spring material disposed so as to apply biasing force in a longitudinal direction of an associated one of said spools.

7. An ink ribbon cartridge as set forth in claim 6, wherein said compatibility determining means is provided in said third bearing portion disposed between said first and second bearing portions.

8. An ink ribbon cartridge as set forth in claim 7, wherein an installation position/of said third bearing portion and a size of said circumferential groove is variable.

9. An ink ribbon cartridge comprising:

a spool having an ink ribbon wound around a central, axially extending cylindrical winding surface thereof, said spool including first and second shank portions axially projected from opposing end portions of said cylindrical winding surface;

a shell including first and second bearing portions rotatably supporting said spool at said first and second shank portions thereof, respectively; and compatibility determining means disposed along and cooperative with one of said shank portions, said compatibility determining means being separate from said first and a second bearing portions;

wherein said compatibility determining means comprises a circumferential groove formed on a selected one of said shank portions and a member mounted to said shell defining a recess, a position of said member and a width of said recess being determined such that said recess may receive and rotatably support said shank only at the circumferential groove thereof.

10. An ink ribbon cartridge, comprising:

a spool having an ink ribbon wound around a central, axially extending cylindrical winding surface thereof, said spool including first and second shank portions axially projected from opposing end portions of said cylindrical winding surface;

a shell including first and second bearing portions rotatably supporting said spool at said first and second shank portions thereof, respectively; and compatibility determining means disposed along and cooperative with one of said shank portions, said compatibility determining means being separate from said first and second bearing portions;

wherein said compatibility determining means provides a third bearing portion rotatably supporting said spool between said first and second bearing portions; and wherein said third bearing portion is formed of a spring material disposed so as to apply biasing force in a longitudinal direction of said spool.

* * * * *